United States Patent [19]

Kondo et al.

[11] 4,412,787

[45] Nov. 1, 1983

[54] SWASH-PLATE TYPE COMPRESSOR HAVING AN IMPROVED LUBRICANT OIL FEEDING ARRANGEMENT

[75] Inventors: Hiroshi Kondo; Tsunenori Shibuya, both of Konan, Japan

[73] Assignee: Diesel Kiki Co., Ltd., Saitama, Japan

[21] Appl. No.: 306,249

[22] Filed: Sep. 28, 1981

[30] Foreign Application Priority Data

Oct. 6, 1980 [JP] Japan ..... 55-139601

[51] Int. Cl.[3] ..... F04B 1/16; F04B 1/18

[52] U.S. Cl. ..... 417/269; 92/79

[58] Field of Search ..... 417/269; 92/79

[56] References Cited

U.S. PATENT DOCUMENTS

| | | | |
|---|---|---|---|
| 1,689,178 | 10/1928 | Strebler | 92/79 |
| 1,696,436 | 12/1928 | Gray | 92/79 |
| 4,070,136 | 1/1978 | Nakayama | 417/269 |
| 4,289,453 | 9/1981 | Shibuya | 417/269 |
| 4,299,543 | 10/1981 | Shibuya | 417/269 |
| 4,347,046 | 8/1982 | Brucken | 417/269 |

*Primary Examiner*—William L. Freeh

*Attorney, Agent, or Firm*—Frishauf, Holtz, Goodman & Woodward

[57] ABSTRACT

In a swash-plate type compressor, a refrigerant gas deflecting wall is formed in a suction passageway extending through the cylinder block and the valve plates, the deflecting wall extending substantially at right angles to the direction of flow of refrigerant gas travelling in the suction passageway. The suction passageway is partitioned from the swash plate chamber by a partition wall which has an axially extending portion formed with an opening. The refrigerant gas flowing in an upstream portion of the suction passageway is deflected by the refrigerant gas deflecting wall into the swash plate chamber through the above opening to have lubricant oil separated therefrom, and then is delivered into a downstream portion of the suction passageway through the same opening.

12 Claims, 8 Drawing Figures

SWASH-PLATE TYPE COMPRESSOR HAVING AN IMPROVED LUBRICANT OIL FEEDING ARRANGEMENT

BACKGROUND OF THE INVENTION

This invention relates to a swash-plate type compressor for compressing refrigerant gas circulating in an air conditioning system, and more particularly to improvements in or to the lubricant oil feeding arrangement of the swash-plate type compressor.

In a swash-plate type compressor of this kind in general, rotation of the swash plate which is obliquely secured on the drive shaft causes reciprocating motions of the pistons within their respective cylinder bores to carry out pumping actions in cooperation with suction valves and discharge valves. The swash plate and the pistons engage each other with balls and shoes intervening therebetween in a manner that rotation of the swash plate is transduced into reciprocating motions of the pistons. According to this arrangement, the swash plate, the shoes, the balls and the pistons have their sliding contact portions subjected to severe friction and therefore require to be permanently fed with lubricant oil. Conventional automatic lubricant oil feeding systems include an oil-splashing type in which an oil reservoir is provided below the swash plate and lubricant oil stored in the oil reservoir is splashed upwardly by the outer fringe of the rotating swash plate to be fed to the sliding contact portions of the aforementioned parts. Further, part of the lubricant oil thus splashed is transformed into an oily mist and guided together with the refrigerant gas floating in the swash plate chamber towards the low pressure chambers to lubricate the radial bearings journalling the drive shaft and their neighboring parts. The oily mist introduced into the low pressure chambers is mixed into the refrigerant gas in the same chambers and then discharged into the refrigerating circuit of the air conditioning system for circulation therein. The lubricant oil in the refrigerating circuit is again returned to the compressor and forced into the swash plate chamber together with blow-bye gas generated by the compression actions of the pistons and then again stored in the oil reservoir. Therefore, the amount of lubricant oil to be used in a compressor of this type is set at such a value as ensures that the lubricant oil always keeps a suitable surface level in the oil reservoir, taking into account the amount of lubricant oil to circulate in the refrigerating circuit.

However, if lubricant oil stagnates in a portion of the refrigerating circuit, there occurs a delay in the return of the lubricant oil to the oil reservoir, resulting in lowering of the oil surface level in the oil reservoir below the lower end of the outer fringe of the swash plate. This can cause the temporary phenomenon that no lubricant oil is splashed by the swash plate, leading to insufficient lubrication of the sliding contact portions of the swash plate, the shoes, etc., which may even involve seizure trouble.

OBJECTS AND SUMMARY OF THE INVENTION

It is an object of the invention to provide a swash-plate type compressor which is provided with a lubricant oil feeding arrangement which allows direct introduction of lubricant oil-containing refrigerant gas into the swash plate chamber from the refrigerant gas suction passageway for separation of the lubricant oil from the refrigerant gas in the swash plate chamber, to thereby ensure positive lubrication of the swash plate, the shoes, etc. and expeditious return of the lubricant oil to the oil reservoir.

It is a further object of the invention to provide a swash-plate type compressor which is arranged to guide refrigerant gas from one of the low pressure chambers formed within the cylinder heads secured to the opposite ends of the cylinder block to the other low pressure chamber by way of the refrigerant gas suction passageway and the swash plate chamber, which enables forming the outer periphery of the compressor, particularly the cylinder block in a shape identical with a conventional one, to thereby facilitate installment of the compressor into a vehicle or the like.

According to the invention, a refrigerant gas deflecting wall is provided across a suction passageway which extends through the cylinder block and the valves plates for guiding suction refrigerant gas from one of the low pressure chambers defined within cylinder heads secured to the opposite ends of the cylinder block, to the other low pressure chamber. The refrigerant gas deflecting wall extends substantially at right angles to the direction of flow of refrigerant gas travelling in the suction passageway to divide the same passageway into an upstream side and a downstream side. The suction passageway is partitioned from the swash plate chamber defined within the cylinder block by means of a partition wall which has an axially extending portion formed with an opening which communicates the suction passageway with the swash plate chamber. The refrigerant gas deflecting wall and the partition wall are in such a positional relationship that refrigerant gas travelling in the suction passageway is deflected by the refrigerant gas deflecting wall at the upstream side of the suction passageway, hence guided through the above opening in the partition wall into a substantially axially central zone in the swash plate chamber, and thereafter delivered from the swash plate chamber into the downstream side of the suction passageway through the above opening in the partition wall.

The above and other objects, features and advantages of the invention will be more apparent from the ensuing detailed description taken in connection with the accompanying drawings in which:

DETAILED DESCRIPTION

Preferred embodiments of the invention will now be described by reference to the drawings.

Figure 1:
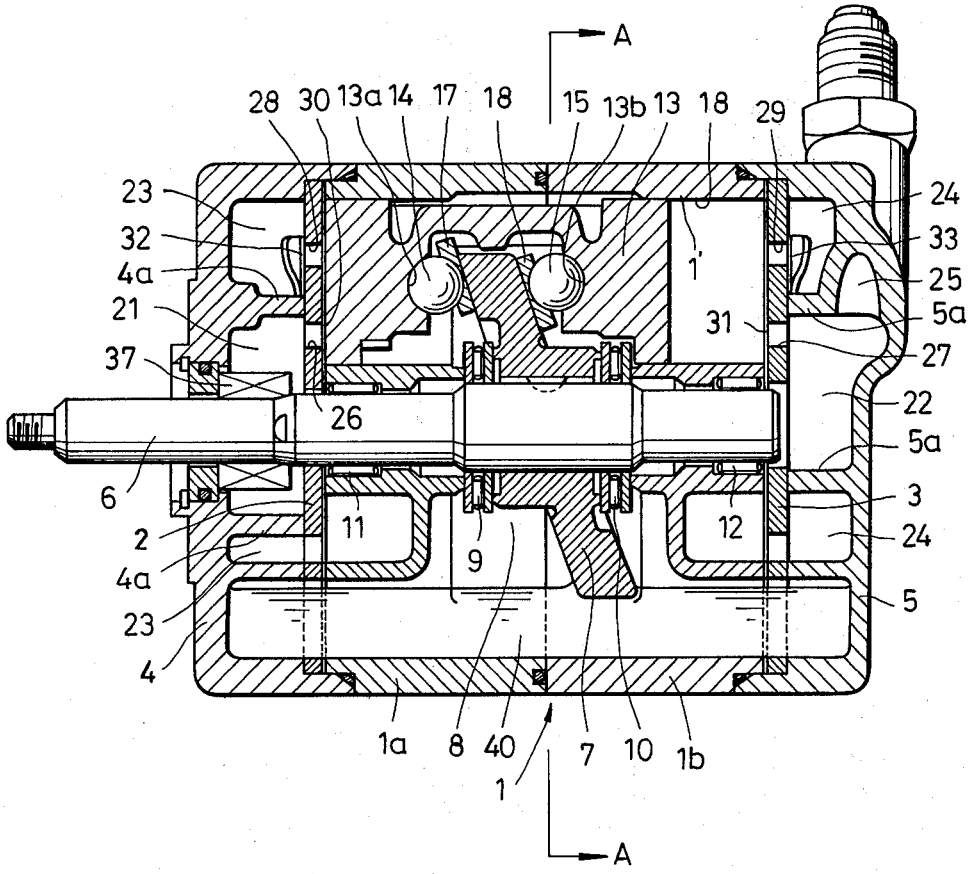
FIG. 1 is a longitudinal sectional view of a swash-plate type compressor according to a first embodiment of the invention.
Figure 2:
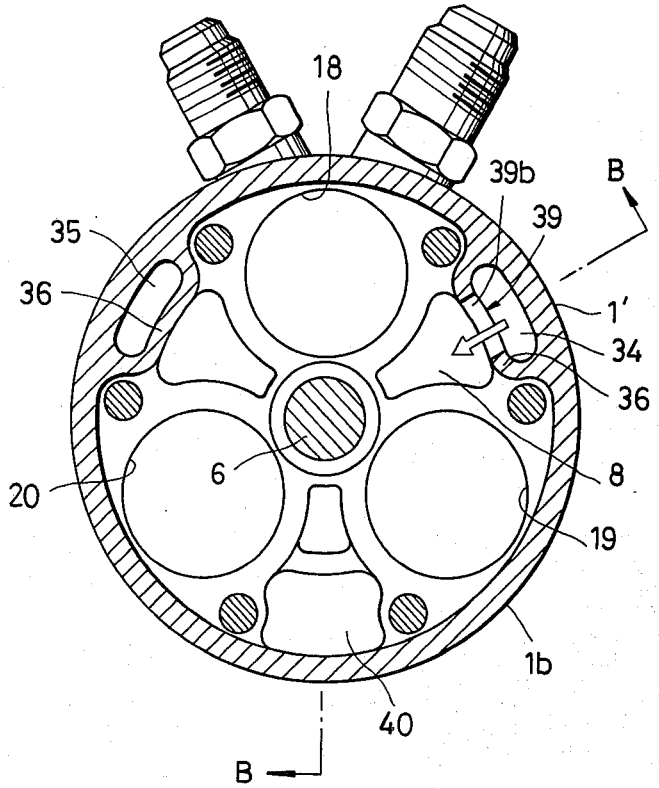
FIG. 2 is a sectional view taken along line A—A in FIG. 1, with the swash plate, the pistons, the balls and the shoes omitted.
Figure 3:
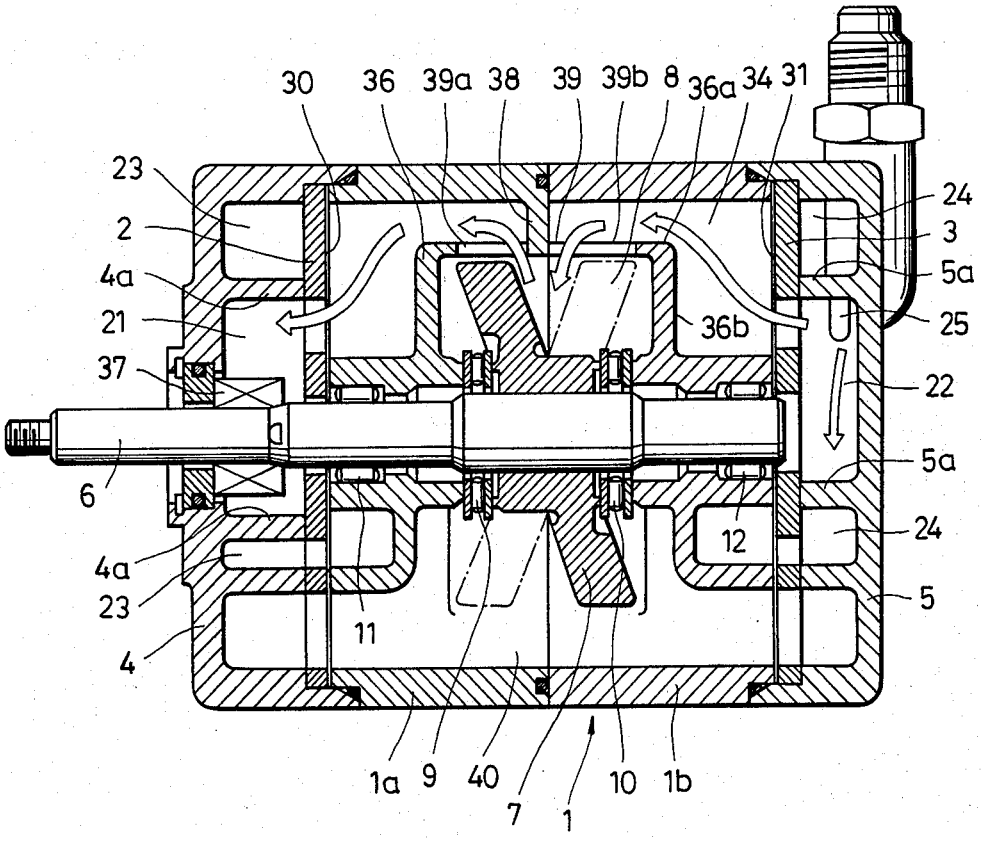
FIG. 3 is a sectional view taken along line B—B in FIG. 2.

Referring first to FIGS. 1 through 3, there is illustrated a first embodimentof the invention. A pair of cylindrical members 1*a*, 1*b*, which form a cylinder block 1, have mainly their outer peripheral walls joined together at ends in axial alignment. Secured to the opposite ends of the cylinder block 1 are front and rear cylinder heads 4, 5 with valve plates 2, 3 intervening therebetween. A drive shaft 6, which is arranged to be driven by a driver, not shown, extends through the cylinder block 1 along the axis of the latter, with its front end portion projected to the outside of the compressor.

A swash plate 7 is obliquely secured on the drive shaft 6 and accommodated within a swash plate chamber 8 defined substantially at the center of the cylinder block 1. The swash plate 7 and the drive shaft 6 are supported by thrust bearings 9, 10 and radial bearings 11, 12 for rotation relative to the cylinder block 1.

Three double-acting pistons 13 (only one of them is shown) each have its central portion formed with a central recess which has semispherical ball pockets 13*a*, 13*b* formed in its opposite inner end walls. The pistons 13 each have its cental recess engaging the swash plate 7 in a manner holding the swash plate 7 at its opposite side surfaces, by means of balls 14, 15 fitted in the ball pockets 13*a*, 13*b* and shoes 16, 17 engaging the balls 14, 15. The pistons 13 are slidably received within three cylinder bores 18, 19, 20 formed through the cylinder block 1 and extending parallel with the drive shaft 6 and at circumferentially equal intervals. Thus, when the swash plate 7 is swingingly rotated in unison with the rotating drive shaft 6, it urges the shoes 17, 18 while sliding thereon to cause reciprocating motions of the pistons 13 within the respective cylinder bores 18, 19, 20.

The cylinder bores 18, 19, 20 have their opposite end faces covered with valve plates 2, 3 and their central portions communicating with the swash plate chamber 8.

The cylinder heads 4, 5 are formed therein with annular partition walls 4*a*, 5*a*, respectively, which divide the interiors of the respective cylinder heads into low pressure chambers 21, 22 and high pressure chambers 23, 24 which are thus located at the opposite ends of the cylinder block 1. The low pressure chamber 22 and the high pressure chamber 24 on the rear side are provided, respectively, with a suction port 25 and a discharge port, not shown, which open in the respective chambers and through which refrigerant gas with lubricant oil mixed therein in several percent (hereinafter merely called "refrigerant gas" unless otherwise defined) is sucked in from the refrigerating circuit and discharged into the same circuit, respectively. The low pressure chambers 21, 22 communicate with the cylinder bores 18, 19, 20 through suction openings 26, 27 formed through the valve plates 2, 3, while the high pressure chambers 23, 24 communicate with the same bores through discharge openings 28, 29 also formed through the valve plates 2, 3. The above suction openings 26, 27 and discharge openings 28, 29 are provided, respectively, with suction valves 30, 31 and discharge valves 32, 33 at opposite side surfaces of the valve plates 2, 3, to be closed by these valves. In this embodiment, the low pressure chamber 21 on the front side communicates with the low pressure chamber 22 on the rear side through a suction passageway 34 formed through the cylinder block 1 and the valve plates 2, 3, while the high pressure chamber 23 on the front side communicates with the high pressure chamber 24 on the rear side through a discharge passageway 35 formed through the cylinder block 1 and the valve plates 2, 3. The portions of the suction passageway 34 and discharge passageway 35 which are located within the cylinder block 1 each have its radially outer side wall defined by the outer peripheral wall 1' of the cylinder block 1 and its radially inner wall defined by a partition wall 36 formed integrally with the cylinder block 1. The partition wall 36 also serves to partition the passageway 34, 35 from the swash plate chamber 8. A sealing device 37 is arranged around the drive shaft 6 in the low pressure chamber 21 on the front side to seal the drive shaft 6 against the front cylinder head 4.

A refrigerant gas deflecting wall 38 is provided across the suction passageway 34, which extends substantially at right angles to the direction of flow of the refrigerant gas travelling in the suction passageway 34. In this embodiment, the refrigerant gas deflecting wall 38 is formed integrally on the outer peripheral wall of the cylindrical member 1*a* on the front side at abutting ends of the cylindrical members 1*a*, 1*b*, and extends toward the radial center of the cylinder block 1. Thus, the deflecting wall 38 is located on substantially the same plane with the axial center of the swash plate chamber 8.

The partition wall 36 defining part of the suction passageway 34 is formed of an axially extending portion 36*a* and a radially extending portion 36*b*. The axially extending portion 36*a* of the partition wall 36 has a refrigerant gas passing opening 39 formed therethrough. The refrigerant gas deflecting wall 38 and the refrigerant gas passing opening 39 are in such a positional relationship that the refrigerant gas is deflected by the deflecting wall 38 and then introduced into the swash plate chamber 8 at its substantially axially central portion. In this embodiment, the refrigerant gas deflecting wall 38 has its radially inner end inserted in the refrigerant gas passing opening 39 to divide the same opening into an outlet opening 39*a* formed in the cylindrical member 1*a* on the front side and an inlet opening 39*b* formed in the cylindrical member 1*b* on the rear side. The above radially inner end of the deflecting wall 38 is located on substantially the same plane with the radially inner end of the refrigerant gas passing opening 39.

An oil reservoir 40 is formed below the swash plate chamber 8 and extends as far as the front and rear cylinder heads 4, 5. The swash plate 7 has its outer fringe immersed in lubricant oil stored in the oil reservoir 40.

With the above arrangement, as the drive shaft 6 is rotated, the swash plate 7 is swingingly rotated to cause reciprocating motions of the pistons 13 within their respective cylinder bores 18, 19, 20 to carry out compressing actions in cooperation with the suction valves 30, 31 and the discharge valves 32, 33. At the same time, the rotating swash plate 7 upwardly splashes the lubricant oil stored in the oil reservoir 40 to feed it to the sliding contact portions of the swash plate 7 and the shoes 17, 18, the shoes 17, 18 and the balls 14, 15, and the balls 14, 15 and the pistons 13.

The refrigerant gas is sucked into the low pressure chamber 22 on the rear side through the suction port 25 and then divided into two flows as shown by the arrows in FIG. 3 so that part of the refrigerant gas is delivered into the low pressure chamber 21 on the front side through the suction passageway 34. On the way to the chamber 21, the refrigerant gas is guided along the radially extending portion 36*b* of the partition wall 36 toward the refrigerant gas deflecting wall 38 and deflected downward, i.e., in the radially central direction by the refrigerant gas deflecting wall 38 at a rear or upstream side of the suction passageway 34 and hence guided through the inlet portion 39*b* of the refrigerant passing opening 39 into a substantially axially central zone in the swash plate chamber 8. The refrigerant gas thus introduced into the swash plate chamber 8 is struck against the both side surfaces of the swash plate 7 to be suddenly changed in flow direction to cause separation of the lubricant oil from the refrigerant gas. The lubricant oil thus separated from the refrigerant gas is fed to the sliding contact portions of the swash plate 7 and the shoes 17, 18, etc. to lubricate the same.

By virtue of the above arrangement, a sufficient amount of lubricant oil can be positively fed to the above sliding contact portions even when there occurs a drop in the oil surface level in the oil reservoir 40 to such an extent that no lubricant oil is splashed by the swash plate 7, thus eliminating the possibility of seizure, etc. Further, separation of lubricant oil from refrigerant gas within the swash plate chamber 8 expedites return of lubricant oil to the oil reservoir 40.

The refrigerant gas, after being separated from the lubricant oil in the swash plate chamber 8, is then delivered into the suction passageway 34 at its front or downstream side through the outlet portions 39*a* of the refrigerant gas passing opening 39 and hence guided along the same passageway 34 into the low pressure chamber 21 on the front or downstream side.

Equivalent results to those described above can be obtained from the arrangements according to other embodiments of the invention shown in FIGS. 4 through 8, wherein the refrigerant gas deflecting wall 38 and the refrigerant gas passing opening 39 are disposed such that suction refrigerant gas is guided into a substantially axially central zone in the swash plate chamber 8, as in the preceding or first embodiment.

Figure 4:
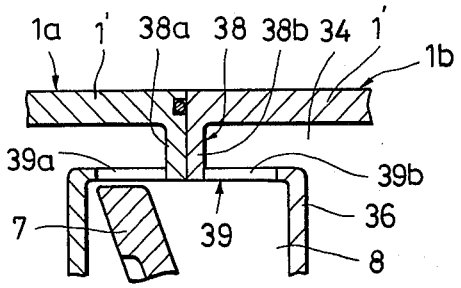
FIG. 4 is a longitudinal sectional view of an essential part of a swash-plate type compressor according to a second embodiment of the invention.

Referring to FIG. 4, there is shown a second embodiment of the invention. In this embodiment, the refrigerant gas deflecting wall 38 is formed by two walls 38*a*, 38*b* abutting on each other and extending integrally from the abutting ends of the outer peripheral walls of the cylindrical members 1*a*, 1*b*.

Figure 5:
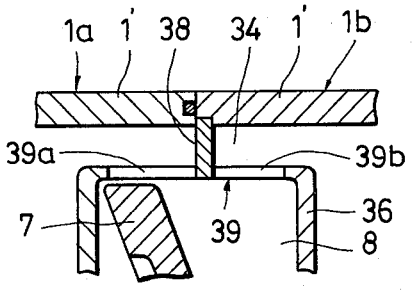
FIG. 5 is a view similar to FIG. 4, illustrating a third embodiment of the invention.

In FIG. 5, there is shown a third embodiment of the invention. According to the FIG. 5 arrangement, the refrigerant gas deflecting wall 38 is formed by a piece separately fabricated from the cylinder block 1. The wall piece has its radially outer end tightly held between the abutting ends of the cylindrical members 1*a*, 1*b*.

Figure 6:
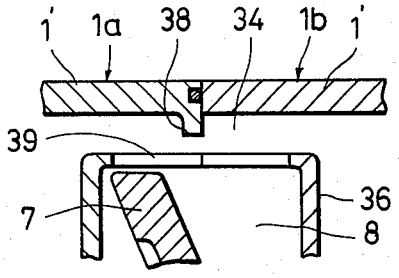
FIG. 6 is a view similar to FIG. 4, illustrating a fourth embodiment of the invention.

Referring to FIG. 6 where a fourth embodiment of the invention is illustrated, the refrigerant gas deflecting wall 38 has such a small length that its radially inner end terminates short of the partition wall 36 but is located in the suction passageway 34, with the refrigerant gas passing opening 39 left as a single large opening. According to this arrangement, only part of the refrigerant gas travelling along the suction passageway 34 is guided into the swash plate chamber 8.

Figure 7:
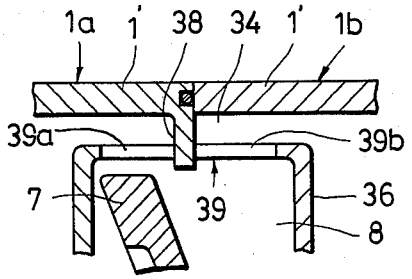
FIG. 7 is a view similar to FIG. 4, illustrating a fifth embodiment of the invention.

Referring to FIG. 7 where a fifth embodiment of the invention is illustrated, the refrigerant gas deflecting wall 38 has such a large length that its radially inner end is projected into the swash plate chamber 8 through the refrigerant gas passing opening 39.

Figure 8:
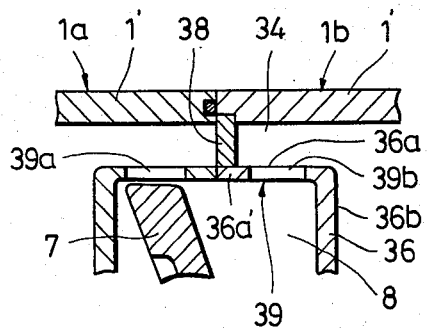
FIG. 8 is a view similar to FIG. 4, illustrating a sixth embodiment of the invention.

Lastly in FIG. 8, a sixth embodiment of the invention is illustrated. The axial portion 36*a* of the partition wall 36 has a solid wall portion 36*a*'at its substantially axial center. The refrigerant gas deflecting wall 38 has its radially inner end abutting on the solid wall portion 36*a*'and accordingly the outlet portion 39*a* and inlet portion 39*b* of the refrigerant gas passing opening 39 are completely separated from each other.

Obviously many modifications and variations of the present invention are possible in the light of the above teachings. It is therefore to be understood that within the scope of the appended claims the invention may be practiced otherwise than as specifically described.

What is claimed is:

1. In a swash-plate type compressor of the type having a pair of cylindrical members joined together in axial alignment and forming a cylinder block; a pair of cylinder heads secured to opposite ends of said cylinder block, said cylinder heads having first and second low pressure chambers defined therein, respectively, said first low pressure chamber having a refrigerant gas suction port opening therein; a pair of valve plates interposed between said cylinder block and said cylinder heads; means defining a suction passageway extending through said cylinder block and said valve plates at a radially outer location in said cylinder block for guiding suction refrigerant gas from said first low pressure chamber to said second low pressure chamber; and means defining a swash plate chamber at a substantially central location in said cylinder block, said swash plate chamber accommodating a swash plate secured on a drive shaft and engaging pistons slidably received within cylinder bores of said cylinder block for causing reciprocating motions of said pistons; said suction passageway defining means and said swash plate chamber defining means including a partition wall partitioning said suction passageway from said swash plate chamber, the improvement comprising a refrigerant gas deflecting wall provided across said suction passageway and radially extending, said deflecting wall being located on substantially the same plane with the axial center of said swash plate chamber, said deflecting wall extending substantially at right angles to the direction of flow of refrigerant gas travelling in said suction passageway to divide said suction passageway into an upstream side and a downstream side; said partition wall having an axially extending portion and a radially extending portion, said axially extending portion of said partition wall being formed with an opening communicating said suction passageway with said swash plate chamber; said opening being divided into an upstream side and a downstream side with respect to said deflecting wall, said upstream side and said downstream side of said opening being located on the same axial plane; said refrigerant gas deflecting wall and said partition wall being in a positional relationship such that refrigerant gas travelling in said suction passageway is guided toward said refrigerant gas deflecting wall along said radially extending portion of said partition wall and deflected by said refrigerant gas deflecting wall at said upstream side of said suction passageway, hence guided through said opening in said partition wall into a substantially axially central zone in said swash plate chamber, and thereafter delivered from said swash plate chamber into said downstream side of said suction passageway through said opening in said partition wall.

2. The swash-plate type compressor as claimed in claim 1, wherein said refrigerant gas deflecting wall has a radially inner end projected into said swash plate chamber through said opening in said partition wall.

3. The swash-plate type compressor as claimed in claim 1, wherein said refrigerant gas deflecting wall has a radially inner end located in said suction passageway.

4. The swash-plate type compressor as claimed in claim 1, wherein said cylindrical members have outer peripheral walls thereof joined together at ends thereof, said outer peripheral walls forming part of said suction passageway defining means, said refrigerant gas deflecting wall radially inwardly extending integrally from the joining end of the outer peripheral wall of one of said cylindrical members.

5. The swash-plate type compressor as claimed in claim 1, wherein said cylindrical members have outer peripheral walls thereof joined together at ends thereof, said outer peripheral walls forming part of said suction passageway defining means, said refrigerant gas deflecting wall comprising two walls radially inwardly extending integrally from the joining ends of the outer peripheral walls of said cylindrical members.

6. The swash-plate type compressor as claimed in claim 1, wherein said cylindrical members have outer peripheral walls thereof joined together at ends thereof, said outer peripheral walls forming part of said suction passageway defining means, said refrigerant gas deflecting wall comprising a member separately fabricated from said cylinder block, said deflecting wall member having a radially outer end tightly held between the joining ends of the outer peripheral walls of said cylindrical members.

7. The swash-plate type compressor as claimed in claim 1, wherein said axially extending portion of said partition wall has a solid wall portion at a substantially axial center thereof, said refrigerant gas deflecting wall having a radially inner end abutting on said solid wall portion.

8. The swash-plate type compressor as claimed in claim 1, wherein said refrigerant gas deflecting wall has a radially inner end inserted in said opening in said partition wall to divide said opening into a refrigerant gas inlet portion and a refrigerant gas outlet portion.

9. The swash-plate type compressor as claimed in claim 8, wherein said opening in said partition wall has a radially inner end, said radially inner end of said refrigerant gas deflecting wall being located on substantially the same plane with said radially inner end of said opening in said partition wall.

10. In a swash-plate type compressor of the type having a pair of cylindrical members joined together in axial alignment and forming a cylinder block; a pair of cylinder heads secured to opposite ends of said cylinder block, said cylinder heads having first and second low pressure chambers defined therein, respectively, said first low pressure chamber having a refrigerant gas suction port opening therein; a pair of valve plates interposed between said cylinder block and said cylinder heads; means defining a suction passageway extending through said cylinder block and said valve plates at a radially outer location in said cylinder block for guiding suction refrigerant gas from said first low pressure chamber to said second low pressure chamber; and means defining a swash plate chamber at a substantially central location in said cylinder block, said swash plate chamber accommodating a swash plate secured on a drive shaft and engaging pistons slidably received within cylinder bores of said cylinder block for causing reciprocating motions of said pistons; said suction passageway defining means and said swash plate chamber defining means including a partition wall partitioning said suction passageway from said swash plate chamber, the improvement comprising a refrigerant gas deflecting wall provided across said suction passageway, said deflecting wall extending substantially at right angles to the direction of flow of refrigerant gas travelling in said suction passageway to divide said suction passageway into an upstream side and a downstream side; said partition wall having an axially extending portion formed with an opening communicating said suction passageway with said swash plate chamber; said refrigerant gas deflecting wall having a radially inner end which projects into said swash plate chamber through said opening in said partition wall and said refrigerant gas deflecting wall and said opening in said partition wall being in a positional relationship such that refrigerant gas travelling in said suction passageway is deflected by said refrigerant gas deflecting wall at said upstream side of said suction passageway, hence guided through said opening in said partition wall into a substantially axially central zone in said swash plate chamber, and thereafter delivered from said swash plate chamber into said downstream side of said suction passageway through said opening in said partition wall.

11. In a swash-plate type compressor of the type having a pair of cylindrical members joined together in axial alignment and forming a cylinder block; a pair of cylinder heads secured to opposite ends of said cylinder block, said cylinder heads having first and second low pressure chambers defined therein, respectively, said first low pressure chamber having a refrigerant gas suction port opening therein; a pair of valve plates interposed between said cylinder block and said cylinder heads; means defining a suction passageway extending through said cylinder block and said valve plates at a radially outer location in said cylinder block for guiding suction refrigerant gas from said first low pressure chamber to said second low pressure chamber; and means defining a swash plate chamber at a substantially central location in said cylinder block, said swash plate chamber accommodating a swash plate secured on a drive shaft and engaging pistons slidably received within cylinder bores of said cylinder block for causing reciprocating motions of said pistons; said suction passageway defining means and said swash plate chamber defining means including a partition wall partitioning said suction passageway from said swash plate chamber, the improvement comprising a refrigerant gas deflecting wall provided across said suction passageway, said deflecting wall extending substantially at right angles to the direction of flow of refrigerant gas travelling in said suction passageway to divide said suction passageway into an upstream side and a downstream side; said partition wall having an axially extending portion formed with an opening communicating said suction passageway with said swash plate chamber; said cylindrical members having outer peripheral walls thereof joined together at ends thereof, said outer peripheral walls forming part of said suction passageway defining means; said refrigerant gas deflecting wall comprising two walls radially inwardly extending integrally from the joining ends of said outer peripheral walls of said cylindrical members; said refrigerant gas deflecting wall and said opening in said partition wall being in a positional relationship such that refrigerant gas travelling in said suction passageway is deflected by said refrigerant gas deflecting wall at said upstream side of said suction passageway, hence guiding through said opening in said partition wall into a substantially axially central zone in said swash plate chamber, and thereafter delivered from said swash plate chamber into said downstream side of said suction passageway through said opening in said partition wall.

12. In a swash-plate type compressor of the type having a pair of cylindrical members joined together in axial alignment and forming a cylinder block; a pair of cylinder heads secured to opposite ends of said cylinder block, said cylinder heads having first and second low pressure chambers defined therein, respectively, said first low pressure chamber having a refrigerant gas suction port opening therein; a pair of valve plates interposed between said cylinder block and said cylinder heads; means defining a suction passageway extending through said cylinder block and said valve plates at a radially outer location in said cylinder block for guiding suction refrigeration gas from said first low pressure chamber to said second low pressure chamber; and means defining a swash plate chamber at a substantially central location in said cylinder block, said swash plate chamber accommodating a swash plate secured on a drive shaft and engaging pistons slidably received within cylinder bores of said cylinder block for causing reciprocating motions of said pistons; said suction passageway defining means and said swash plate chamber defining means including a partition wall partitioning said suction passageway from said swash plate chamber, the improvement comprising a refrigerant gas deflecting wall provided across said suction passageway, said deflecting wall extending substantially at right angles to the direction of flow of refrigerant gas travelling in said suction passageway to divide said suction passageway into an upstream side and a downstream side; said partition wall having an axially extending portion formed with an opening communicating with said suction passageway with said swash plate chamber; said cylindrical members having outer peripheral walls thereof joined together at ends thereof, said outer peripheral walls forming part of said suction passageway defining means; said refrigerant gas deflecting wall comprising a deflecting wall member separately fabricated from said cylinder block, said deflecting wall member having a radially outer end tightly held between the joining ends of said outer peripheral walls of said cylindrical members; said refrigerant gas deflecting wall and said opening in said partition wall being in a positional relationship such that refrigerant gas travelling in said suction passageway is deflected by said refrigerant gas deflecting wall at said upstream side of said suction passageway, hence guided through said opening in said partition wall into a substantially axially central zone in said swash plate chamber, and thereafter delivered from said swash plate chamber into said downstream side of said suction passageway through said opening in said partition wall.

* * * * *